US011448010B2

(12) United States Patent
Lei et al.

(10) Patent No.: US 11,448,010 B2
(45) Date of Patent: Sep. 20, 2022

(54) LADDER TAPE DEVICE FOR A VENETIAN BLIND

(71) Applicants: Zhenbang Lei, Dongguan (CN); Xingbang Lei, Dongguan (CN)

(72) Inventors: Zhenbang Lei, Dongguan (CN); Xingbang Lei, Dongguan (CN)

( * ) Notice: Subject to any disclaimer, the term of this patent is extended or adjusted under 35 U.S.C. 154(b) by 30 days.

(21) Appl. No.: 17/043,746

(22) PCT Filed: May 29, 2018

(86) PCT No.: PCT/CN2018/088825
§ 371 (c)(1),
(2) Date: Sep. 30, 2020

(87) PCT Pub. No.: WO2019/227303
PCT Pub. Date: Dec. 5, 2019

(65) Prior Publication Data
US 2021/0062576 A1 Mar. 4, 2021

(51) Int. Cl.
*E06B 9/382* (2006.01)
*E06B 9/303* (2006.01)
*E06B 9/322* (2006.01)

(52) U.S. Cl.
CPC ..... *E06B 9/382* (2013.01); *E06B 9/303* (2013.01); *E06B 9/322* (2013.01)

(58) Field of Classification Search
CPC ..... E06B 9/382; E06B 9/303; E06B 9/322
See application file for complete search history.

(56) References Cited

U.S. PATENT DOCUMENTS

| | | | | |
|---|---|---|---|---|
| 3,269,453 | A * | 8/1966 | Vecchiarelli | E06B 9/322 160/176.1 R |
| 6,601,636 | B1 * | 8/2003 | Liu | E06B 9/322 160/177 R |
| 2010/0186907 | A1 * | 7/2010 | Kraler | E06B 9/307 160/176.1 P |
| 2017/0016274 | A1 * | 1/2017 | Zheng | E06B 9/304 |

* cited by examiner

*Primary Examiner* — Daniel P Cahn
*Assistant Examiner* — John W Hanes, Jr.

(57) ABSTRACT

A ladder tape device for a venetian blind includes a U-shaped fixing base fixed in a head rail of the venetian blind, a ladder tape retainer with opposite ends placed on corresponding two side-panels of the fixing base, a plurality of ladder tapes with a top end of each ladder tape passing through the fixing base and being wound on the ladder tape retainer, and a limiting cover buckled on the top end of the fixing base, an inner wall of the limiting cover and an outer wall of the top end of the ladder tape retainer are separated by a predetermined distance to form a ladder tape limiting space.

5 Claims, 4 Drawing Sheets

LADDER TAPE DEVICE FOR A VENETIAN BLIND

BACKGROUND OF THE INVENTION

1. Field of the Invention

The present invention relates to venetian blind technical field and, more particularly to a ladder tape device for a venetian blind.

2. Description of Related Art

A venetian blind can be opened and closed by driving slats to rotate through a plurality of ladder tapes. A ladder tape retainer is fixed to a head rail of the venetian blind by means of a U-shaped fixing base, a current ladder tape retainer has a horizontal cylinder as main portion, a fixing groove is formed in the side wall of the ladder tape retainer. A top end of each ladder tape is fixed in the fixing groove and is wound the ladder tape retainer with several rings, and the other end of each ladder tape extends downward through the fixing base and the head rail to connected with the slats, the ladder tape retainer is coaxially and fixedly connected with a driving shaft. When the driving shaft rotates under operating of an operator or driving of a motor, the ladder tape retainer is driven to rotate synchronously, so that the ladder tapes wind in the corresponding direction, and then the slats are driven to rotate corresponding angles so as to be opened or closed. In this process, sometimes, all the slats need to be pulled up to the top of the venetian blind, at this moment, the ladder tapes are slack and cannot wind the ladder tape retainer well, the ladder tapes can move easily and clamp into the gap between the ladder tape retainer and the fixing base, so that the ladder tapes cannot well achieve synchronous activity in the subsequent process, and the slat cannot turn flexibly.

SUMMARY OF THE INVENTION

Therefore, the technical problem to be solved by the embodiments of the present invention is to provide a ladder tape device of a venetian blind, which effectively make the ladder tapes wind the ladder tape retainer well.

To solve the above-mentioned technical problems, an embodiment of the present invention provides a ladder tape device for a venetian blind, which includes a U-shaped fixing base fixed in a head rail of the venetian blind, a ladder tape retainer with opposite ends placed on corresponding two side-panels of the fixing base, a plurality of ladder tapes with a top end of each ladder tape passing through the fixing base and being wound on the ladder tape retainer, and a limiting cover buckled on the top end of the fixing base, an inner wall of the limiting cover and an outer wall of the top end of the ladder tape retainer are separated by a predetermined distance to form a ladder tape limiting space.

Furthermore, opposite ends of the limiting cover located in the axial direction of the ladder tape retainer are respectively placed on a top surface of the fixing base, and opposite sides of the limiting cover in the direction perpendicular to the axial direction of the ladder tape retainer extend out to form elastic buckling hooks correspondingly, and the elastic buckling hooks are correspondingly hooked and fixed on side walls of the head rail.

Furthermore, the limiting cover is integrally formed in a shape that a middle portion of the limiting cover in the axial direction is wider than opposite end portions of the limiting cover in the axial direction, the length of the middle portion of the limiting cover is matched with the spacing between the two side-panels of the fixing base, and the opposite end portions of the limiting cover is placed on a top surfaces of the two side-panels of the fixing base.

Furthermore, a stepped opening is further provided in the limiting cover with two narrow openings at opposite ends of the stepped opening and a wide opening in a middle portion of the stepped opening, and the ladder tapes are wound on a portion of the ladder tape retainer corresponding to the wide opening.

Furthermore, a distance between the inner wall of sections corresponding to the two narrow openings at the opposite ends of the stepped opening and the outer wall of the top of the ladder tape retainer is smaller than a distance between the inner wall of a section corresponding to the wide opening of the stepped opening and the outer wall of the top of the ladder tape retainer.

Furthermore, the ladder tape retainer is further provided with a shaft hole penetrating through two end faces of the ladder tape retainer, a driving shaft for driving the ladder tape retainer to rotate passes through the shaft hole and is fixed relative to an inner wall of the shaft hole wall in a circumferential direction.

By adopting the above-mentioned technical solutions, the beneficial effects of the embodiments of the present invention are as follows. The limiting cover is buckled and arranged at the top end of the fixing base, a ladder tape limiting space is formed between the inner wall of the limiting cover and the outer wall of the top of the ladder tape retainer at a preset distance, Therefore, the ladder tapes movable space can be effectively limited when the ladder tapes are loosened, and the ladder tapes are made to wind the ladder tape retainer well. In particular, the ladder tapes can be well prevented from being clamped into the gap between the ladder tape retainer and the fixing base, in the subsequent process, the ladder tapes are always well synchronously movable, so that the slats connected to the ladder tapes can be overturned accurately.

DETAILED DESCRIPTION OF THE INVENTION

The present application will be further described in detail below with reference to the accompanying drawings and specific embodiments. It should be understood that the following illustrative embodiments and illustrations are only used to explain the present invention and are not intended to limit the invention, and that the embodiments of the present invention and the features of the embodiments can be combined with each other without conflict.

Figure 1:
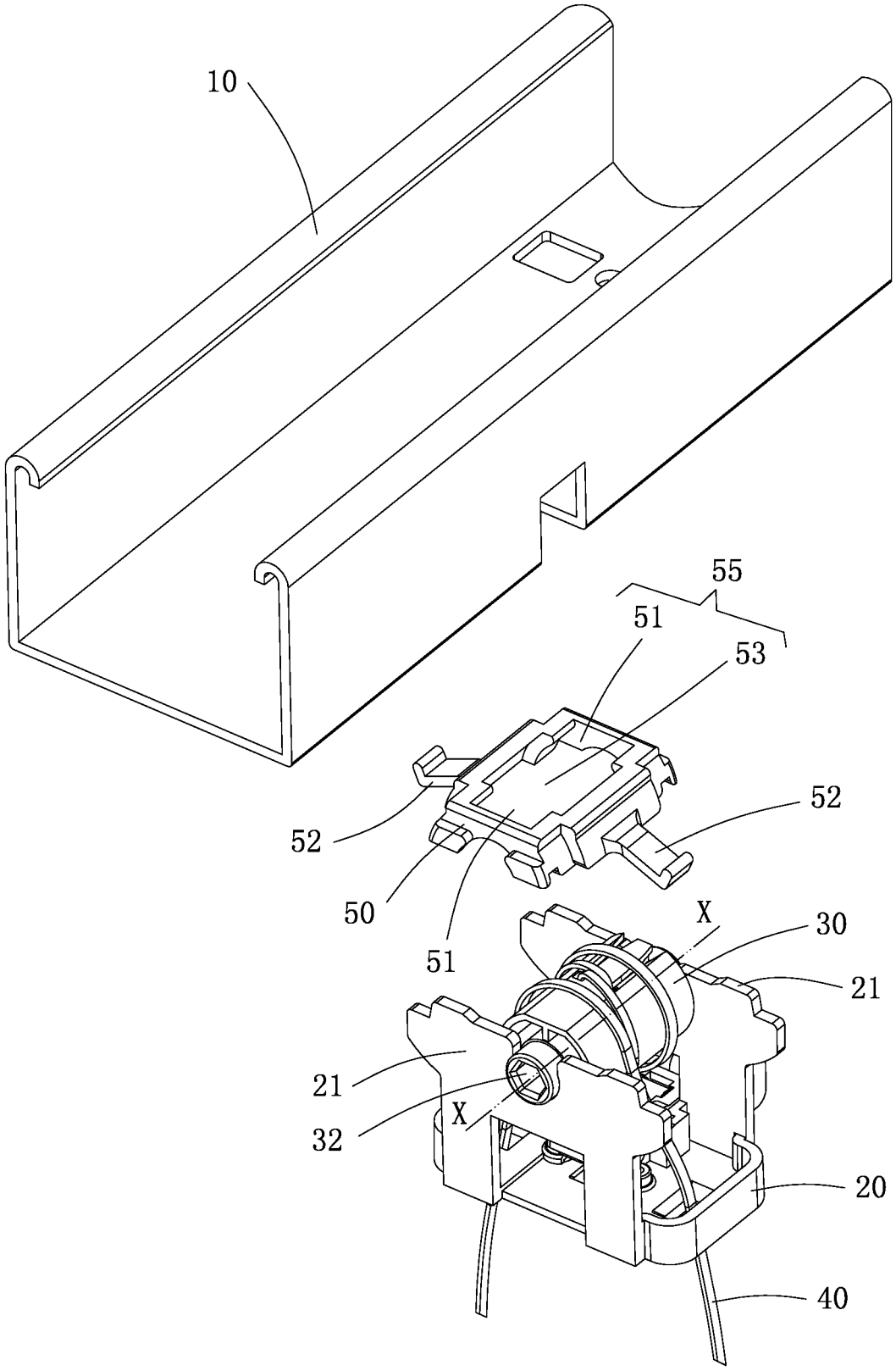
FIG. 1 is an exploded, isometric view of an embodiment of a ladder tape device for a venetian blind of the present invention.
Figure 2:
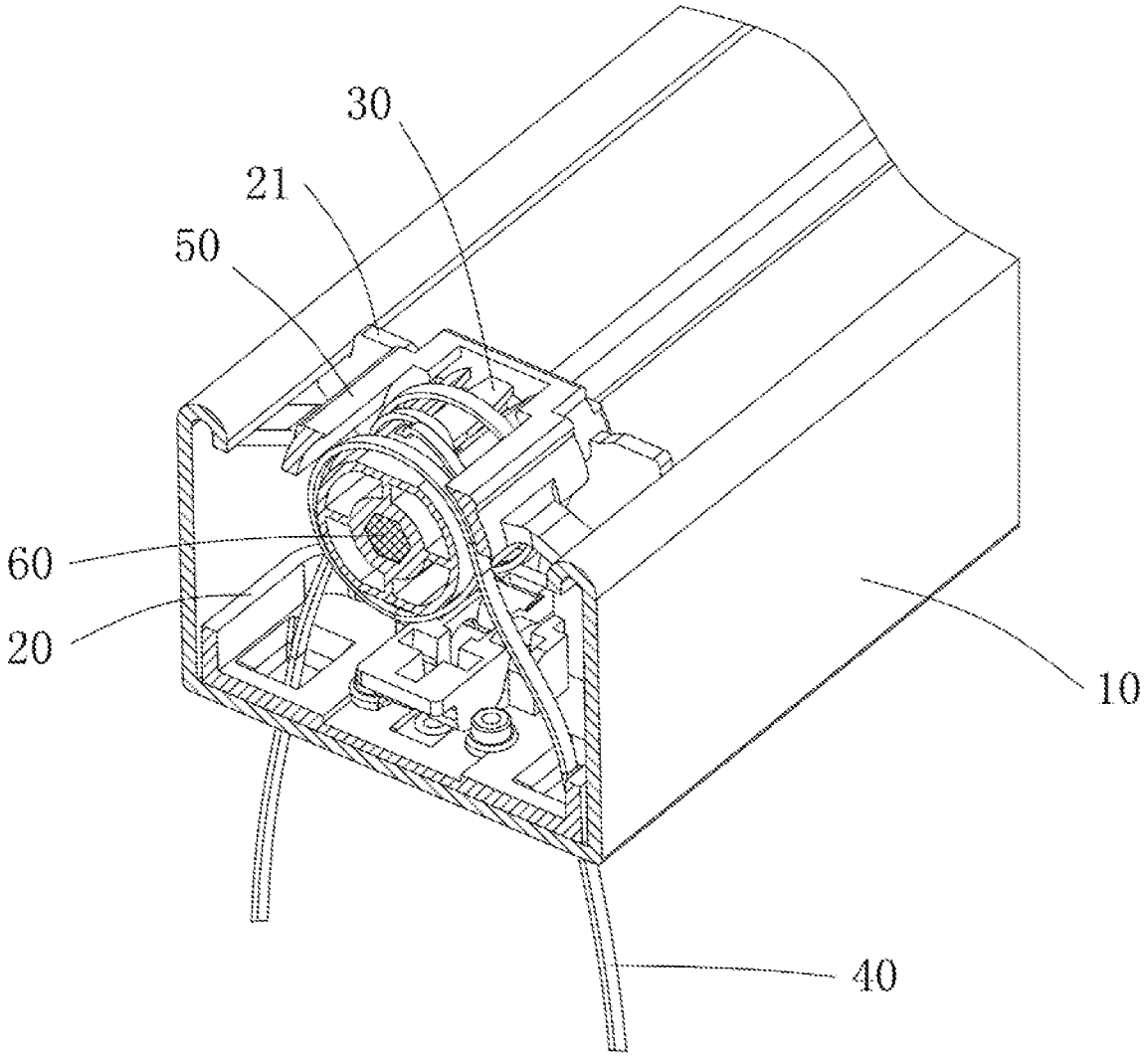
FIG. 2 is an assembled, isometric view of FIG. 1, but partially cut away.
Figure 3:
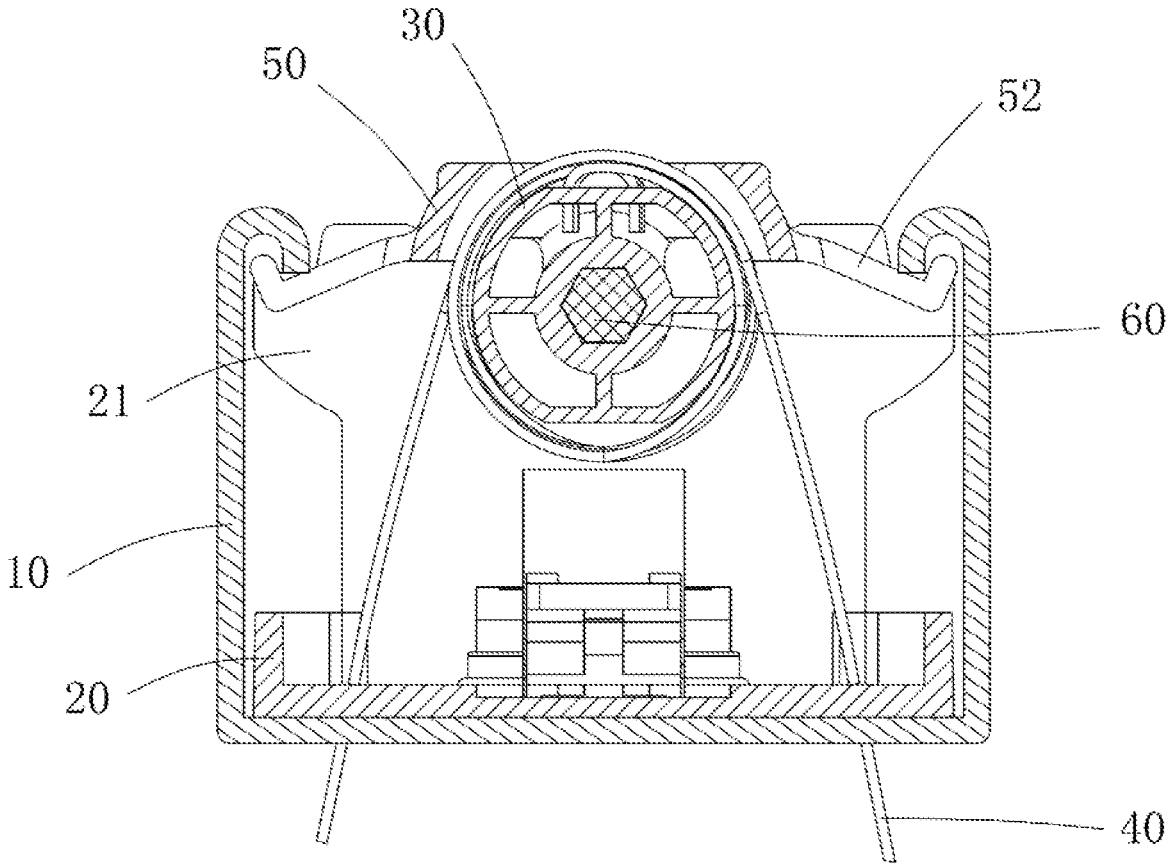
FIG. 3 is a front plan view of FIG. 2.
Figure 4:
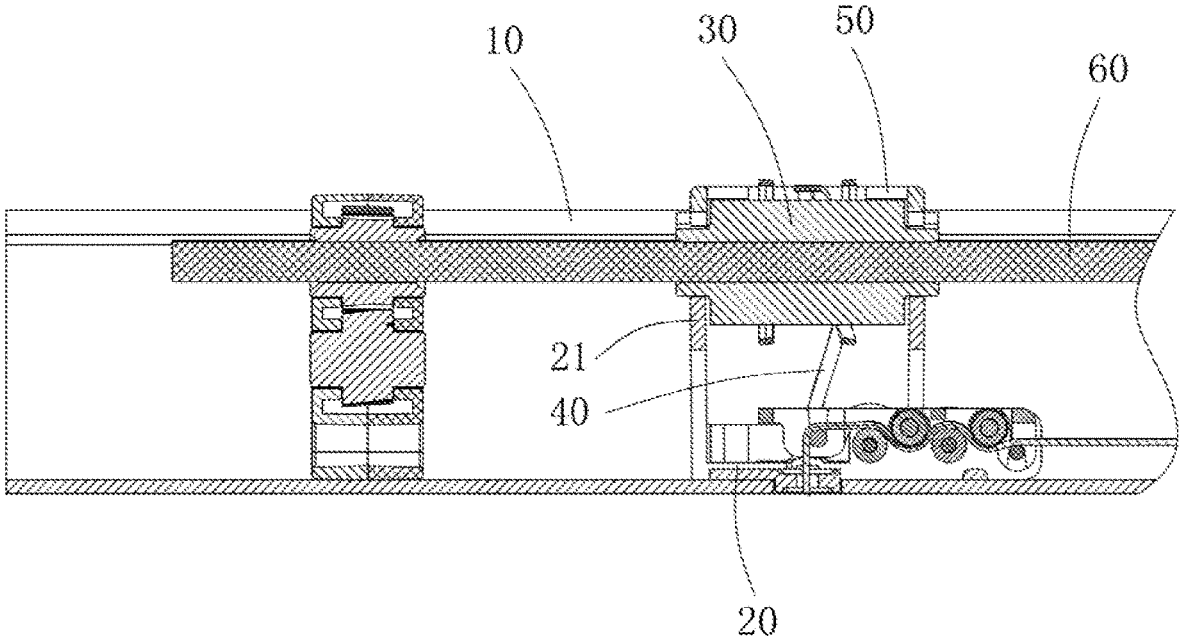
FIG. 4 is a longitudinal cross-sectional view of a ladder tape device for a venetian blind of the present invention.

Referring to FIGS. 1-4, an embodiment of the present disclosure provides a ladder tape device for a venetian blind, which includes a U-shaped fixing base 20 fixed in a head rail 10 of the venetian blind, a ladder tape retainer 30 with opposite ends placed on corresponding two side-panels 21 of the fixing base 20, a plurality of ladder tapes 40 with a top end of each ladder tape 40 passing through the fixing base 20 and being wound on the ladder tape retainer 30, and a limiting cover 50 buckled on the top end of the fixing base 20, an inner wall of the limiting cover 50 and an outer wall of the top end of the ladder tape retainer 30 are separated by a predetermined distance to form a ladder tape limiting space.

In the embodiment of the present invention, the limiting cover 50 is buckled and arranged at the top end of the fixing base 20, a ladder tape limiting space is formed between the inner wall of the limiting cover 50 and the outer wall of the top of the ladder tape retainer 30 at a preset distance, Therefore, the ladder tapes 40 movable space can be effectively limited when the ladder tapes 40 are loosened, and the ladder tapes 40 are made to wind the ladder tape retainer 30 well. In particular, the ladder tapes 40 can be well prevented from being clamped into the gap between the ladder tape retainer 30 and the fixing base 20, in the subsequent process, the ladder tapes 40 are always well synchronously movable, so that the slats (not shown) connected to the ladder tapes 40 can be overturned accurately.

In an alternative embodiment of the present invention, opposite ends of the limiting cover 50 located in the axial direction X-X of the ladder tape retainer 30 are respectively placed on a top surface of the fixing base 20, and opposite sides of the limiting cover 50 in the direction perpendicular to the axial direction of the ladder tape retainer 30 extend out to form elastic buckling hooks 52 correspondingly, and the elastic buckling hooks 52 are correspondingly hooked and fixed on side walls of the head rail 10. In the embodiment, the elastic buckling hook 52 is provided, which can cooperate with the head rail 10 to assemble the limiting cover 50 on the top end of the fixing base 20, so that the assembly operation is convenient and rapid.

In another alternative embodiment of the present invention, the limiting cover 50 is integrally formed in a shape that a middle portion of the limiting cover 50 in the axial direction is wider than opposite end portions of the limiting cover 50 in the axial direction, the length of the middle portion of the limiting cover 50 is matched with the spacing between the two side-panels 21 of the fixing base 20, and the opposite end portions of the limiting cover 50 are placed on top surfaces of the two side-panels 21 of the fixing base 20. In the embodiment, the middle portion of the limiting cover 50 is wider than the opposite end portions of the limiting cover 50, the limiting cover 50 is limited to move in the axial direction through the cooperation of the wider middle portion of the limiting cover 50 and the two side panels 21 of the fixing base 20, and the narrow opposite end portions of the limiting cover 50 are placed on the top surfaces of the two side panels 21 of the fixing base 20 and can cooperate with the elastic buckling hooks 52 to define the activity of the limiting cover 50 in an up-down direction.

In another alternative embodiment of the present invention, a stepped opening 55 is further provided in the limiting cover 50 with two narrow openings 51 at opposite ends of the stepped opening 55 and a wide opening 53 in a middle portion of the stepped opening 55, and the ladder tapes 40 are wound on a portion of the ladder tape retainer 30 corresponding to the wide opening 53. In the embodiment, the stepped opening 55 is provided, the ladder tapes 40 are wound the portion of the ladder tape retainer 30 corresponding to the wide opening 53, and the range of activity of the ladder tapes 40 can be limited in a region farther from the connection position of the ladder tape retainer 30 and the fixing base 20, and the ladder tapes 40 will not clamp into the gap between the ladder tape retainer 30 and the fixing base 20.

In another alternative embodiment of the present invention, a distance between the inner wall of sections corresponding to the two narrow openings 51 at the opposite ends of the stepped opening 55 and the outer wall of the top of the ladder tape retainer 30 is smaller than a distance between the inner wall of a section corresponding to the wide opening 53 of the stepped opening 55 and the outer wall of the top of the ladder tape retainer 30. In the embodiment, the distance between the inner wall of sections corresponding to the two narrow openings 51 at the opposite ends of the stepped opening 55 and the outer wall of the top of the ladder tape retainer 30 is smaller, the activity range of the ladder tapes 40 can be better limited in the area far away from the connection position of the ladder tape retainer 30 and the fixing base 20, and the ladder tapes 40 can be effectively prevented from clamping into the gap between the ladder tape retainer 30 and the fixing base 20.

In another alternative embodiment of the present invention, the ladder tape retainer 30 is further provided with a shaft hole 32 penetrating through opposite end faces of the ladder tape retainer 30, a driving shaft 60 for driving the ladder tape retainer 30 to rotate passes through the shaft hole 32 and is fixed relative to an inner wall of the shaft hole 32 in a circumferential direction. In the embodiment, the driving shaft 60 is arranged in the ladder tape retainer 30 in a penetrating mode, which can achieve higher transmission efficiency, better transmission synchronism, and make the slats turn rapidly.

The embodiments of the present invention have been described above with reference to the drawings, while the present invention is not limited to the above-mentioned specific embodiments. The above-mentioned embodiments are only schematic, and are not intended to limit the scope of the present invention. Under the enlightenment of the present invention, those of ordinary skill in the art can also make many forms without departing from the scope of the present invention and the scope of the claims, all of which fall within the protection scope of the present invention.

What is claimed is:

1. A ladder tape device for a venetian blind, comprising:

a U-shaped fixing base fixed in a head rail of the venetian blind;

a ladder tape retainer with opposite ends placed on corresponding two side-panels of the fixing base;

a plurality of ladder tapes with a top end of each ladder tape passing through the fixing base and being wound on the ladder tape retainer; and a limiting cover buckled on the top end of the fixing base, wherein an inner wall of the limiting cover and an outer wall of the top end of the ladder tape retainer are separated by a predetermined distance to form a ladder tape limiting space;

wherein an opening is integrally defined in a middle of the limiting cover with two narrow openings at opposite ends of the opening and a wide opening between and communicating with the narrow openings, and the wide opening and the narrow openings are arranged in a line parallel to an axial direction of the ladder tape retainer; wherein a width of the wide opening in a direction perpendicular to the axial direction of the ladder tape retainer is greater than widths of the narrow openings in the direction perpendicular to the axial direction of the ladder tape retainer; the plurality of ladder tapes is wound on a portion of the ladder tape retainer below the wide opening.

2. The ladder tape device for a venetian blind of claim 1, wherein opposite ends of the limiting cover located in the axial direction of the ladder tape retainer are respectively placed on a top surface of the fixing base, and opposite sides of the limiting cover in the direction perpendicular to the axial direction of the ladder tape retainer extend out to form elastic buckling hooks correspondingly, and the elastic buckling hooks are correspondingly hooked to and fixed on side walls of the head rail.

3. The ladder tape device for a venetian blind of claim 2, wherein the limiting cover is integrally formed in a shape that a middle portion of the limiting cover in the axial direction is wider than opposite end portions of the limiting cover in the axial direction, the length of the middle portion of the limiting cover is matched with the spacing between the two side-panels of the fixing base, and the opposite end portions of the limiting cover are placed on top surfaces of the two side-panels of the fixing base.

4. The ladder tape device for a venetian blind of claim 3, wherein a distance between the inner wall of sections corresponding to the two narrow openings at the opposite ends of the opening and the outer wall of the top of the ladder tape retainer is smaller than a distance between the inner wall of a section corresponding to the wide opening of the opening and the outer wall of the top of the ladder tape retainer.

5. The ladder tape device for a venetian blind of claim 1, wherein the ladder tape retainer is further provided with a shaft hole penetrating through opposite end faces of the ladder tape retainer, a driving shaft for driving the ladder tape retainer to rotate passes through the shaft hole and is fixed relative to an inner wall of the shaft hole in a circumferential direction.

* * * * *